United States Patent [19]

Quaranto

[11] Patent Number: 4,979,379

[45] Date of Patent: Dec. 25, 1990

[54] JEWELRY CLIP

[75] Inventor: Richard A. Quaranto, North Providence, R.I.

[73] Assignee: Victoria Creations, Inc., Warwick, R.I.

[21] Appl. No.: 445,982

[22] Filed: Dec. 1, 1989

[51] Int. Cl.[5] ..... A44C 7/00

[52] U.S. Cl. ..... 63/14.4

[58] Field of Search ..... 63/14.4, 14.3, 14.5; 24/489, 498, 499, 500, 505, 511, 518, 517

[56] References Cited

U.S. PATENT DOCUMENTS

| | | | |
|---|---|---|---|
| 897,976 | 9/1908 | Germann | 24/498 |
| 2,059,582 | 11/1936 | Hurewitz | 24/511 X |
| 2,447,350 | 8/1948 | Levesque | 63/14.5 |
| 2,501,754 | 3/1950 | Battiste | 63/14.5 |
| 2,745,264 | 5/1956 | Jaron | 63/14.4 |
| 3,020,734 | 2/1962 | Withers | 63/14.4 |

*Primary Examiner*—James R. Brittain

*Attorney, Agent, or Firm*—Salter & Michaelson

[57] ABSTRACT

A jewelry clip includes a face plate, a clamping arm, a bracket for pivotally mounting the clamping arm on the face plate, an eccentric surface on the clamping arm and a resilient brake member. The eccentric surface is formed so that sequential portions thereof are advanced toward the face plate as the clamping arm is pivoted toward the face plate. The brake member engages sequential portions of the eccentric surface to apply increasing braking pressure thereto as the clamping arm is pivoted toward the face plate in order to frictionally retain the clamping arm in a clamping position wherein the clamping arm is closely spaced rearwardly from the face plate for securing an item, such as an earlobe of a wearer, between the clamping arm and the face plate.

2 Claims, 1 Drawing Sheet

JEWELRY CLIP

BACKGROUND AND SUMMARY OF THE INVENTION

The instant invention relates to ornamental jewelry and more particularly to a jewelry clip which can be effectively utilized for comfortably securing an earring to an earlobe of a wearer.

While a variety of different types of clips have been heretofore available for use in connection with jewelry items, such as earrings, most of the heretofore available clips have required relatively complex manipulations to secure them to items, such as the earlobes of wearers. Further, most of the heretofore available clips have not been operative for firmly securing jewelry items to the earlobes of wearers. Still further, because many of the heretofore available clips have included resiliently biased clipping or gripping elements, they have often caused substantial amounts of discomfort to wearers when they have been worn for prolonged periods of time.

The instant invention provides an improved jewelry clip which can be effectively utilized for firmly and positively securing a jewelry item to an item, such as an earlobe of a wearer. Further, the jewelry clip of the instant invention is simple and easy to manipulate and it can be comfortably worn for a prolonged period of time. The jewelry clip of the instant invention comprises a face plate, a clamping arm having opposite first and second ends, and a bracket adjacent the first end of the clamping arm pivotally mounting the clamping arm on the rear side of the face plate so that the second end of the clamping arm is pivotable toward and away from the face plate. The clip further comprises an eccentric surface on the clamping arm which is eccentrically disposed with respect to the pivot axis of the clamping arm and a brake member which is engageable with the eccentric surface for retaining the clamping arm in a clamping position wherein the second end thereof is closely spaced from the rear surface of the face plate. Further, the brake member is engageable with the eccentric surface on the clamping arm for applying increasing braking pressure thereto as the second end of the clamping arm is increasingly pivoted toward the face plate to more effectively retain the clamping arm in the clamping position. In this regard, the eccentric surface is preferably formed so that sequential portions thereof move closer to the rear surface of the face plate as the clamping arm is pivoted so that the second end thereof is moved toward the face plate. Further, the brake member preferably comprises a resilient U-shaped member, including spaced first and second legs, and it is preferably interposed between the eccentric surface and the face plate so that the first leg of the brake member engages the eccentric surface on the clamping arm and is moved toward the second leg of the brake member as the clamping arm is pivoted toward the face plate. Still, further, the clamping arm preferably has an enlarged convex clamping surface thereon which faces toward the face plate when the clamping arm is pivoted to a clamping positioned so that the camping arm can firmly, yet comfortably engage an earlobe of a wearer.

It has been found that the jewelry clip of the instant invention can be effectively utilized for securing an item, such as an earring, to an earlobe of a wearer. In particular, it has been found that the pivot arm is effectively pivotable to a clamping position for firmly securing the clip to an earlobe and because of the manner in which the brake member engages the eccentric surface on the pivot arm, the pivot arm can be effectively and positively releasably secured in a clamping position. In addition, because the pivot arm has an enlarged clamping surface thereon the clip can be comfortably worn for a prolonged period of time.

The closest prior art to the subject invention of which the applicant is aware is disclosed in the U.S. Patent to Jaron, No. 2,745,264. However, since the device disclosed in this reference fails to include an eccentric surface and a brake member of the type utilized in the clip of the subject invention, it is believed to be of only general interest with respect thereto.

Accordingly, it is a primary object of the instant invention to provide an improved clip for positively and firmly securing an earring to an earlobe of a wearer.

Another object of the instant invention is to provide an effective clip which can be easily secured to an earlobe of a wearer with a minimum of manipulations.

An even further object of the instant invention is to provide an effective and simple earring clip which can be comfortably worn on an earlobe of a wearer for a prolonged period of time.

Other objects, features and advantages of the invention shall become apparent as the description thereof proceeds when considered in connection with the accompanying illustrative drawings.

DESCRIPTION OF THE DRAWING:

In the drawing which illustrates the best mode presently contemplated for carrying out the present invention.

DESCRIPTION OF THE INVENTION

Figure 1:
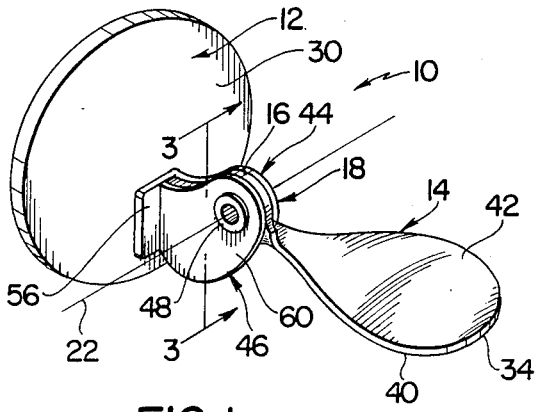
FIG. 1 is a perspective view of the clip of the instant invention.

Referring now to the drawing, the jewelry clip of the instant invention is illustrated and generally indicated at 10 in FIGS. 1–4. The jewelry clip 10 comprises a face plate generally indicated at 12, a clamping arm generally indicated at 14 having an eccentric surface 16 thereon, a bracket assembly 18 and a resilient brake member generally indicated at 20. The bracket assembly 18 is operative for pivotally mounting the clamping arm 16 about a pivot axis 22 which is spaced rearwardly from the face plate 12 so that the clamping arm 14 is pivotable toward and away from the face plate 12. The brake member 20 is assembled in the bracket assembly 18 so that it engages the eccentric surface 16 for releasably retaining the clamping arm 14 in the clamping position illustrated in FIG. 4 wherein the main portion of the clamping arm 14 is closely spaced rearwardly from the face plate 12. The jewelry clip 10 is adapted to be effectively incorporated into an earring assembly of the type generally indicated at 24 in FIG. 4 for use in securing the earring assembly 24 to an earlobe 26 of a wearer.

The face plate 12, as herein illustrated, is constructed from a substantially flat sheet metal and it includes substantially opposite front and rear surfaces 28 and 30, respectively. It will be understood, however, that the face plate can alternatively be constructed in a variety of other configurations and that it can also be integrally formed with an ornament portion of an item, such as an earring, since the main purpose of the face plate 12 is to provide a base for mounting the bracket assembly 18 and a front clamping surface which is operative in combination with the clamping arm 14.

The clamping arm 14 is preferably made from a suitable metal and it has opposite first and second ends 32 and 34, respectively. The clamping arm 14 includes an eccentric portion 36 which is disposed adjacent the first end 32 and a clamping portion 40 which extends from the eccentric portion 36 to the second end 34. The eccentric portion 36 is preferably of substantially circular configuration and the circumferential periphery thereof is preferably defined by the eccentric surface 16. An aperture 38 which is eccentrically disposed with respect to the eccentric surface 16 extends through the eccentric portion 36 as illustrated. The clamping arm 14 is formed and bent so that the gripping portion 40 is disposed in substantially perpendicular relation to the eccentric portion 36, and the gripping portion 40 is preferably formed in an enlarged dimension so that it is substantially larger than the eccentric portion 36. Further, the gripping portion 40 is preferably formed in a rounded configuration as illustrated and it preferably has a convex gripping surface 42 thereon which faces toward the face plate 12 when the clamping arm 14 is in the closed or clamping position thereof illustrated in FIG. 4.

Figure 2:
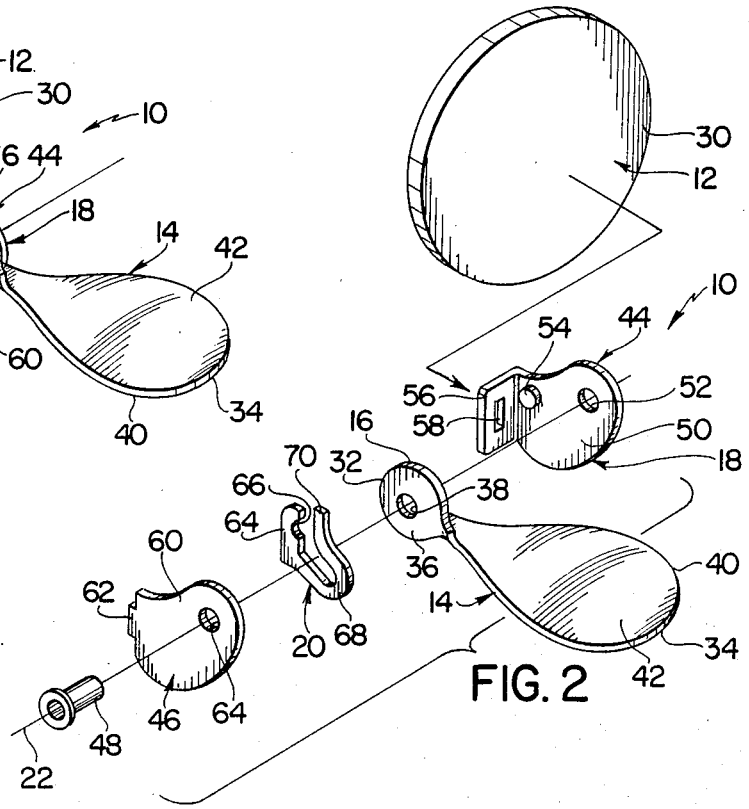
FIG. 2 is an exploded perspective view thereof.

The bracket assembly 18 is illustrated most clearly in FIGS. 1 and 2 and it comprises first and second bracket sections 44 and 46, respectively, and a rivet 48. The first bracket section 44 includes a main plate portion 50 having an aperture 52 therethrough, a pin 54 with extends outwardly from the plate portion 50, and a base portion 56 having a substantially rectangular aperture 58 therethrough. The first bracket section 44 is formed so that the base portion 56 is substantially perpendicular to the plate portion 50 as illustrated and the base portion 56 is preferably secured to the rear side 30 of the face plate 12 by soldering or welding. The second bracket section 46 includes a plate portion 60 which is similar in configuration to the plate portion 50 and a forwardly extending tab 62. The plate portion 60 has an aperture 64 therethrough and the tab 62 is received and secured in the rectangular aperture 58 in the first bracket section 44 so that the plate portions 50 and 60 are in substantially parallel, closely spaced relation and so that the post 54 extends between the plate portions 50 and 60. The rivet 48 is received in the apertures 64 and 52 in the plate portions 60 and 50, respectively, and in the aperture 38 in the clamping arm 14 so that the eccentric portion 36 of the clamping arm 14 is rotatably captured between the plate portions 50 and 60.

The brake member 20 is preferably formed from a suitable resilient metal and it includes a base portion 64 having a notch 66 therein, a U-shaped portion 68 which extends integrally from the base portion 64 and an outwardly curved end portion 70. The U-shaped portion 68 includes first and second spaced legs and it is resiliently compressible by moving the spaced legs thereof together. The brake member 20 is assembled between the plate portions 50 and 60 of the bracket assembly 18 so that the post 54 is received in the notch 66 with the base portion 64 received between the post 54 and the base portion 56. As illustrated most clearly in FIGS. 3 and 4, the brake member 20 is further assembled so that the outer edge of the U-shaped portion 68 and the terminal portion 70 bear against the eccentric surface 16 on the eccentric portion 36 of the clamping arm 14.

Figure 3:
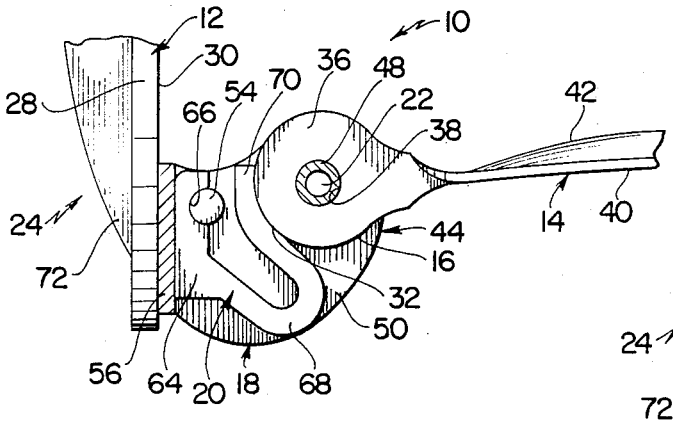
FIG. 3 an enlarged fragmentary side sectional view thereof in an open position.
Figure 4:
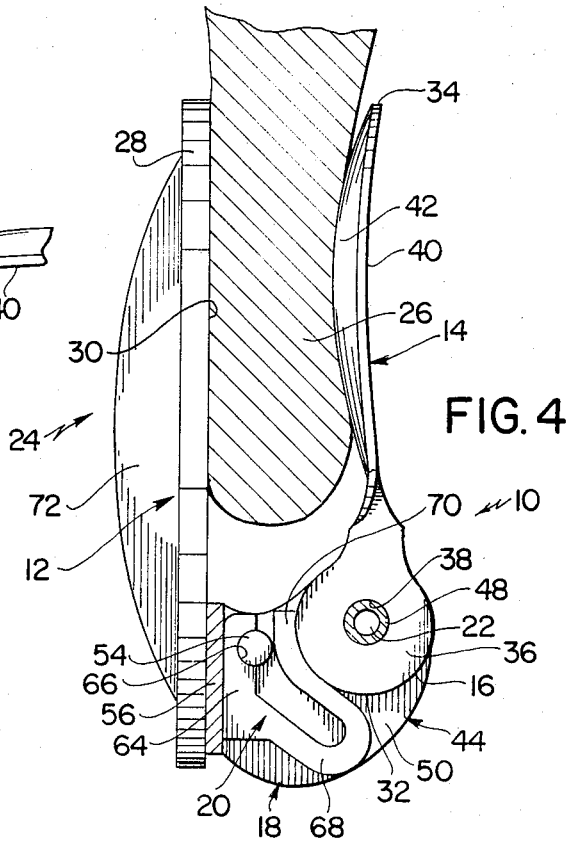
FIG. 4 is an enlarged fragmentary side sectional view thereof in a closed position.

Referring now to FIGS. 3 and 4, the earring 24 is illustrated. As will be seen, the earring 24 includes an ornament member 72 which is secured to the front surface 28 of the face plate 12, such as by welding or soldering. The clip 10 as embodied in the earring 24 is adapted for use in securing the earring 24 to an earlobe 26 of a wearer. However, it will be understood that the clip 10 can also be effectively adapted for use in securing various other types jewelry items to items, such as articles of clothing and the like.

Accordingly, for use and operation of the clip 10 an item, such as the earlobe 26, is positioned adjacent the rear surface 30 of the face plate 12 and the clamping arm 14 is pivoted to a position wherein the clamping portion 40 thereof engages the earlobe 26 to secure the earlobe 26 between the clamping arm 14 and the face plate 12. As the clamping arm 14 is pivoted so that the second end 34 of the clamping arm 14 approaches the face plate 12, the eccentric surface 16 of the eccentric portion 36 presses against the adjacent surface of the break member 20 with increasing force. In this regard, the eccentric portion 36 is formed and the aperture 38 is positioned so that as the clamping arm 14 is pivoted to advance the second end 34 toward the face plate 12, the eccentric surface !6 causes the U-shaped portion 68 to be increasingly resiliently compressed. As a result, gradually increasing frictional resistance is applied to the eccentric surface 16 by the break member 20 causing gradually increasing resistance to further pivoting movement to be applied to the clamping arm 14. Consequently, as the clamping arm 14 is pivoted toward the face plate 12 it is increasingly frictionally retained in position by the break member 20 to enable the clip 10 to be effectively utilized for securing a jewelry item, such as the earring 24, onto an item, such as the earlobe 26. However, since the clip 10 does not require the use of resilient pressure for biasing the clamping arm 14 toward the face plate 12, it can be comfortably worn on an earlobe 26 for a prolonged period of time.

It is seen therefore that the instant invention provides an effective clip for use in connection with jewelry items, such as the earring 24. The clip 10 is constructed so that the break member 20 engages the eccentric surface 16 of the clamping arm 14 with increasing pressure as the clamping arm 14 is pivoted toward the face plate 12. Accordingly, the clamping arm 14 can be effectively retained in various desired clamping position for effectively releasably securing an item, such as the earlobe 26, between the clamping arm 14 and the face plate 12. As a result, it is seen that the clip of the instant invention represents a significant advancement in the jewelry art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A jewelry clip comprising a face plate having front and rear sides, a clamping arm having first and second ends, bracket means on said face plate pivotally mounting said clamping arm adjacent the first end thereof so that it is pivotable about an axis which is spaced rearwardly from the rear side of said face plate for pivoting the second end of said clamping arm toward and away from said face plate, eccentric surface means on said clamping arm adjacent the first end thereof eccentrically disposed with respect to said axis for moving toward and away from said face plate as the second end of said clamping arm is pivoted toward and away from said face plate, and brake means engaging said eccentric surface with increasing pressure as the second end of said clamping arm is pivoted toward said face plate for releasably retaining said clamping arm in a position wherein the second end of said clamping arm is closely spaced from the rear surface of said face plate, said brake means comprising a resilient U-shaped member including spaced first and second legs, said first leg engaging said eccentric surface means and moving toward said second leg as said clamping arm is pivoted toward said face plate.

2. In the jewelry clip of claim 1, said U-shaped member being interposed between said eccentric surface means and said face plate.

* * * * *